US006415949B1

(12) United States Patent
Tramontina

(10) Patent No.: US 6,415,949 B1
(45) Date of Patent: Jul. 9, 2002

(54) CONTAINER AND CARTRIDGE FOR DISPENSING CONTROLLED AMOUNTS OF PAPER PRODUCTS

(75) Inventor: Paul Francis Tramontina, Alpharetta, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 09/578,240

(22) Filed: May 24, 2000

(51) Int. Cl.[7] ..... A47K 10/24

(52) U.S. Cl. ..... 221/45; 221/197

(58) Field of Search ..... 221/33, 44, 45, 221/46, 48, 49, 63, 197, 198; 206/499, 409, 459

(56) References Cited

U.S. PATENT DOCUMENTS

| | | | | |
|---|---|---|---|---|
| 371,473 | A | 10/1887 | Onderdonk | |
| 813,594 | A | 2/1906 | Sexton | |
| 1,170,380 | A | 2/1916 | Winter | |
| 1,236,055 | A | 8/1917 | Cohn | |
| 1,579,429 | A | 4/1926 | Arms | |
| 1,605,231 | A | 11/1926 | Hoberg | |
| 1,665,057 | A | 4/1928 | Genest | |
| 1,709,214 | A | 4/1929 | Griffith et al. | |
| D92,455 | S | 6/1934 | Coles | |
| 1,974,926 | A | 9/1934 | Marsh | 206/44 |
| 1,989,381 | A | 1/1935 | Samson | 312/62 |
| 2,033,582 | A | 3/1936 | Materno | 206/57 |
| 2,143,614 | A | 1/1939 | Winter et al. | 206/57 |
| 2,195,437 | A | 4/1940 | West | 312/60 |
| 2,323,395 | A | 7/1943 | Harwood | 206/57 |
| 2,730,267 | A | 1/1956 | Marcalus | 221/48 |

(List continued on next page.)

FOREIGN PATENT DOCUMENTS

| | | | |
|---|---|---|---|
| DE | 1289274 | | 2/1969 |
| EP | 0331027 | A1 | 9/1989 |
| EP | 0372781 | A1 | 6/1990 |
| EP | 0419063 | A2 | 3/1991 |
| EP | 0779053 | | 6/1997 |
| EP | 0811348 | A2 | 12/1997 |
| FR | 336986 | | 11/1903 |
| FR | 1537127 | | 7/1968 |
| FR | 2362610 | | 3/1978 |
| GB | 423276 | | 1/1935 |
| GB | 1112680 | | 5/1968 |
| JP | 3-187873 | | 8/1991 |
| SU | 149028 | | 3/1955 |
| WO | 97/09918 | | 3/1997 |
| WO | 97/22528 | | 6/1997 |
| WO | 98/22009 | | 5/1998 |
| WO | 98/40002 | | 9/1998 |
| WO | WO 99/30601 | * | 1/1999 |
| WO | 99/30601 | | 6/1999 |

OTHER PUBLICATIONS

PCT International Search Report Sep. 13, 2001.

*Primary Examiner*—Kenneth W. Noland
(74) *Attorney, Agent, or Firm*—Dority & Manning, P.A.

(57) ABSTRACT

A reversible cartridge holding a plurality of paper products and for dispensing a controlled amount of the same from a dispenser housing. The cartridge includes a cartridge body having cartridge walls, the cartridge being insertable into an interior area of a dispenser housing. The cartridge may further include removable sections defined in the cartridge body, removal of at least a portion of the removable portions creating openings in the cartridge. The exterior walls define an interior surface and an interior area within the interior surface for receiving a cartridge holding a plurality of paper products. The cartridge further includes two dispensing throats, a first dispensing throat for dispensing multiple paper products, and the second dispensing throat for dispensing single paper products one at a time. Additional openings could be provided for controlling the dispensing and alignment of the paper products within the cartridge.

23 Claims, 10 Drawing Sheets

U.S. PATENT DOCUMENTS

| | | | | | |
|---|---|---|---|---|---|
| 2,816,376 | A | | 12/1957 | Hirvonen | 40/16 |
| 2,858,016 | A | | 10/1958 | Marano | 206/73 |
| 2,858,045 | A | | 10/1958 | Loeb | 221/59 |
| 3,028,047 | A | | 4/1962 | Tuft | |
| 3,156,378 | A | * | 11/1964 | Bua | 221/197 |
| 3,161,336 | A | | 12/1964 | Loescher | 225/106 |
| 3,164,298 | A | | 1/1965 | Repko | 221/282 |
| 3,203,586 | A | | 8/1965 | Downham | 221/55 |
| 3,258,114 | A | | 6/1966 | King | 206/44.12 |
| 3,272,385 | A | | 9/1966 | Watkins | 221/48 |
| 3,343,716 | A | | 9/1967 | Peebles | 221/46 |
| 3,349,959 | A | | 10/1967 | Watkins | 221/48 |
| 3,724,716 | A | | 4/1973 | Baraconi et al. | 221/47 |
| 3,747,802 | A | | 7/1973 | Uroshevich | 221/63 |
| 3,754,681 | A | | 8/1973 | Slye et al. | 221/45 |
| 4,004,691 | A | | 1/1977 | Wihksne | 206/459 |
| 4,411,374 | A | | 10/1983 | Hotchkiss | 221/63 |
| D275,345 | S | | 9/1984 | Hall | D6/518 |
| 4,469,243 | A | | 9/1984 | Ito et al. | 221/34 |
| 4,491,242 | A | | 1/1985 | Trinidad | 221/312 R |
| 4,566,607 | A | | 1/1986 | Smith | 221/155 |
| 4,623,074 | A | | 11/1986 | Dearwester | 221/48 |
| 4,678,099 | A | | 7/1987 | Matsui | 221/48 |
| 4,679,703 | A | | 7/1987 | De Luca | 221/52 |
| 4,706,844 | A | | 11/1987 | Omdoll et al. | 221/59 |
| 4,768,679 | A | | 9/1988 | Matsui | 221/48 |
| 4,805,800 | A | | 2/1989 | Nocek et al. | 221/63 |
| 4,838,454 | A | | 6/1989 | Salzmann et al. | 221/57 |
| D302,949 | S | | 8/1989 | Eisendrath | D9/432 |
| 4,877,154 | A | | 10/1989 | Matsui | 221/48 |
| 4,938,382 | A | | 7/1990 | Frazier et al. | 221/45 |
| 5,002,200 | A | | 3/1991 | Hunt | 221/1 |
| 5,020,670 | A | | 6/1991 | Bedford | 206/499 |
| 5,065,895 | A | | 11/1991 | De Luca et al. | 221/54 |
| 5,090,592 | A | | 2/1992 | Petterson et al. | 221/55 |
| 5,100,020 | A | | 3/1992 | Petterson et al. | 221/45 |
| 5,102,007 | A | | 4/1992 | Petterson et al. | 221/6 |
| 5,219,092 | A | | 6/1993 | Morand | 221/53 |
| D347,344 | S | | 5/1994 | Schumaker | D6/515 |
| 5,310,057 | A | | 5/1994 | Caldwell et al. | 206/494 |
| 5,332,118 | A | | 7/1994 | Muckenfuhs | 221/48 |
| 5,346,064 | A | | 9/1994 | Rizzuto | 206/409 |
| 5,356,032 | A | | 10/1994 | Rhodes | 221/47 |
| 5,460,322 | A | | 10/1995 | Carlson et al. | 229/120 |
| 5,476,190 | A | * | 12/1995 | Herrmann et al. | 221/197 |
| D366,583 | S | | 1/1996 | Scaife | D6/515 |
| 5,509,571 | A | | 4/1996 | Weber | 221/46 |
| 5,520,308 | A | | 5/1996 | Berg, Jr. et al. | 221/50 |
| 5,590,813 | A | | 1/1997 | Abramczyk | 221/197 |
| 5,622,281 | A | | 4/1997 | Annand | 221/48 |
| 5,632,409 | A | | 5/1997 | Raghunanan | 221/45 |
| 5,642,836 | A | | 7/1997 | Merriweather, Jr. | 221/62 |
| 5,690,230 | A | | 11/1997 | Griffith | 206/555 |
| 5,836,478 | A | | 11/1998 | Weiss | 221/309 |
| 5,853,845 | A | | 12/1998 | McConnell et al. | 428/126 |
| 5,931,339 | A | | 8/1999 | Dodge et al. | 221/45 |
| D414,085 | S | | 9/1999 | Campbell | D7/631 |
| 5,950,863 | A | | 9/1999 | Schutz et al. | |

* cited by examiner

CONTAINER AND CARTRIDGE FOR DISPENSING CONTROLLED AMOUNTS OF PAPER PRODUCTS

BACKGROUND OF THE INVENTION

This invention relates generally to the field of dispensing devices and systems. More particularly, this invention relates to the field of devices and systems for dispensing paper products such as napkins, towels, bath tissue, etc.

Various types of dispensers for paper products have been developed to provide ready availability of the paper products to users. Such dispensers are often provided in public places such as restaurants or rest rooms where customers remove from the dispenser a desired amount of paper products for personal use. In some high traffic areas, such as fast food restaurants, a large number of customers may use a paper product dispenser such as a napkin dispenser in a short period of time. Therefore, dispensers have been developed that hold a large number of paper products for use by a large number of consumers.

Unfortunately, large dispensers are subject to a number of drawbacks. First, it is difficult to uniformly dispense individual paper products or a controlled amount of paper products from a large dispenser without dispensing more paper products than necessary to a user. Thus, too many paper products are removed by a user, and some of the paper products are wasted. If too many paper products are removed from a dispenser, the benefits provided by a larger dispenser are eliminated as the dispenser is emptied more rapidly.

Second, many dispensers are difficult to load, and that difficulty can increase with the size of the dispenser. If paper products are not properly loaded into the dispenser, the paper products may jam as they are removed thereby preventing further removal of paper products by users. Also, a person refilling a large dispenser is more likely, due to the larger number of paper products involved, to drop some of the paper products onto a floor. Any dropped paper products are then unsanitary and must be discarded, thereby creating more waste and again defeating the benefits of the larger dispenser.

Third, for many currently available dispensers regardless of size, it is impossible to determine without opening the dispenser how many paper products remain within the dispenser. Thus, a person must either periodically check the dispenser to determine how many paper products remain or be vigilant to refill the dispenser as soon as it is empty. Both alternatives involve much personal attention and, especially during peak usage, can lead to empty dispensers if the dispensers are not vigilantly monitored.

Some dispensers may be adapted to dispense paper products from preloaded cartridges. One drawback of these types of dispensers that the cartridge itself is designed to be loaded into and dispensed from a specific configuration of dispenser. This requires the facility to stock the appropriate cartridge for each type of dispenser used. Thus, the facility is required to monitor more than one reserve supply of paper products and to dedicate storage space for each type of preloaded cartridge used.

OBJECTS AND SUMMARY OF THE INVENTION

It is a principle object of the present invention to provide an improved cartridge for dispensing controlled amounts of paper products from a dispenser housing, the improved cartridge being readily adapted to various applications.

Another object of the present invention is to provide a cartridge for dispensing paper products that is simple and inexpensive to manufacture, and that is reliable in use.

Still another object of the present invention is to provide a cartridge for dispensing paper products that provide metered delivery of individual paper products or a controlled amount of paper products.

Yet another object of the present invention is to provide a cartridge for dispensing paper products that reduce the incidence of waste of the paper products, either due to dispensing of too many paper products to a user or due to dropping of the paper products during refilling of a container.

Still another object of the present invention is to provide a cartridge for dispensing paper products that provides an indication of the remaining amount of the paper products ready for dispensing to users.

Yet another object of the present invention is to provide a cartridge for dispensing paper products that reduces the incidence of jamming of paper products and the resultant inability to dispense further paper products.

Yet another object of the present invention is to provide a cartridge for dispensing paper products that can be used in more than one embodiment of dispenser housings or containers.

To achieve these objects and in accordance with the purposes of the invention, as embodied and broadly described herein, a cartridge for holding and dispensing a plurality of paper products includes a cartridge body having cartridge walls and may further include removable sections defined in the cartridge body.

Generally speaking, the cartridge includes a cartridge body having cartridge walls, the cartridge being insertable into an interior area of a dispenser housing. The cartridge may further include removable sections defined in the cartridge body, removal of at least a portion of the removable portions creating openings in the cartridge. In some embodiments, the cartridge wall may include a first slit, slot, orifice or channel that may serve to control access to the paper products held within. Desirably, the first slit is defined by a rear wall and a top wall of the cartridge. However, it is contemplated that other locations may be used.

The first slit is desirably sized so that its horizontal dimension or width is about the same as or slightly greater than the width of the paper products within the cartridge and its vertical dimension or height is large enough to permit the passage of a limited number of paper products. For example, if the paper products are in the form of folded paper napkins, the vertical dimension of the first slit may be sized so that a limited number of folded paper napkins may extracted. This could be achieved by making the vertical dimension some multiple of the thickness of an individual folded paper napkin (e.g., greater than about two and less than about ten thicknesses).

The paper product may be accessed by a thumb slot and/or a finger slot. Desirably, the thumb and finger slots are located on the rear and top walls of the cartridge.

It should be understood that any reference to topographical features used to describe the container are meant to provide relative placement of one feature with respect to another feature and are not meant to designate absolute locations. As such, disposed in a bottom wall of the cartridge or the wall opposite the wall comprising the first slit, may be a second slit, slot, orifice or channel that also may serve to control access to the paper products held within. Desirably, the second slit is wholly contained by a bottom wall of the cartridge. However, it is contemplated that other locations may be used.

The second slit is sized so that only a portion of the face of a paper product is exposed to the user. By exposing only a portion of the paper product, the paper product will be caused to dispense one at a time. For example, if the paper products are in the form of folded paper napkins, the second slit may be sized to enable a user to grasp an exposed face of a single napkin, extract that napkin from the cartridge, leaving the next napkin in the stack exposed.

The cartridge may further define at least one other slot through one of the cartridge walls, the slot being visible from outside a dispenser housing when the cartridge is placed within the interior area of such a dispenser housing. An amount of paper products contained within the cartridge being determinable by visually inspecting the amount of paper products through the slot.

Desirably, other openings are provided in the cartridge for receiving protrusions situated in a dispenser housing. A first group of such protrusions is envisioned to include bumpers adapted to extend into an interior area of the carton to contact paper products and thereby oppose or slow the progression of the paper products in a dispensing direction. A second group of such protrusions is envisioned to include rib members adapted to extend into an interior area of the carton to contact paper products for spacing, slowing, aligning and supporting the paper products as they are moved in the dispensing direction.

It is also contemplated that the cartridge may have at least one additional opening corresponding to a key, rib, pin, or projection of some form located on an interior section of the dispenser housing. The key would permit the cartridge to be loaded properly into the dispenser housing. If a custodian were to attempt to incorrectly load the cartridge into the dispenser or attempt to load the cartridge in the wrong orientation, the key would not engage the opening in the cartridge thus preventing the cartridge from seating within the dispenser.

The above structure enables the cartridge, which has been preloaded with a stack of paper products, to be used with a dispenser adapted to dispense a controlled or limited number of paper products at each dispense or dispensing event. Alternatively the cartridge may be used with a dispenser adapted to dispense paper products one at a time, i.e., single dispensing. The dual use is accommodated desirably by flipping the cartridge end for end so that the front wall is placed in the rear and the rear wall is placed in the front, while switching the orientation of the top and bottom walls as well. As such this configuration would enable dispensing from each end of the stack of paper products.

Additional objects and advantages of the invention will be set forth in part in the following description, or may be obvious from the description, or may be learned through the practice of the invention.

BRIEF DESCRIPTION OF THE DRAWINGS

The present invention will be more fully understood from the following detailed description, taken in conjunction with the accompanying drawings, wherein like reference numerals refer to like parts, and in which.

DETAILED DESCRIPTION

Figure 1:
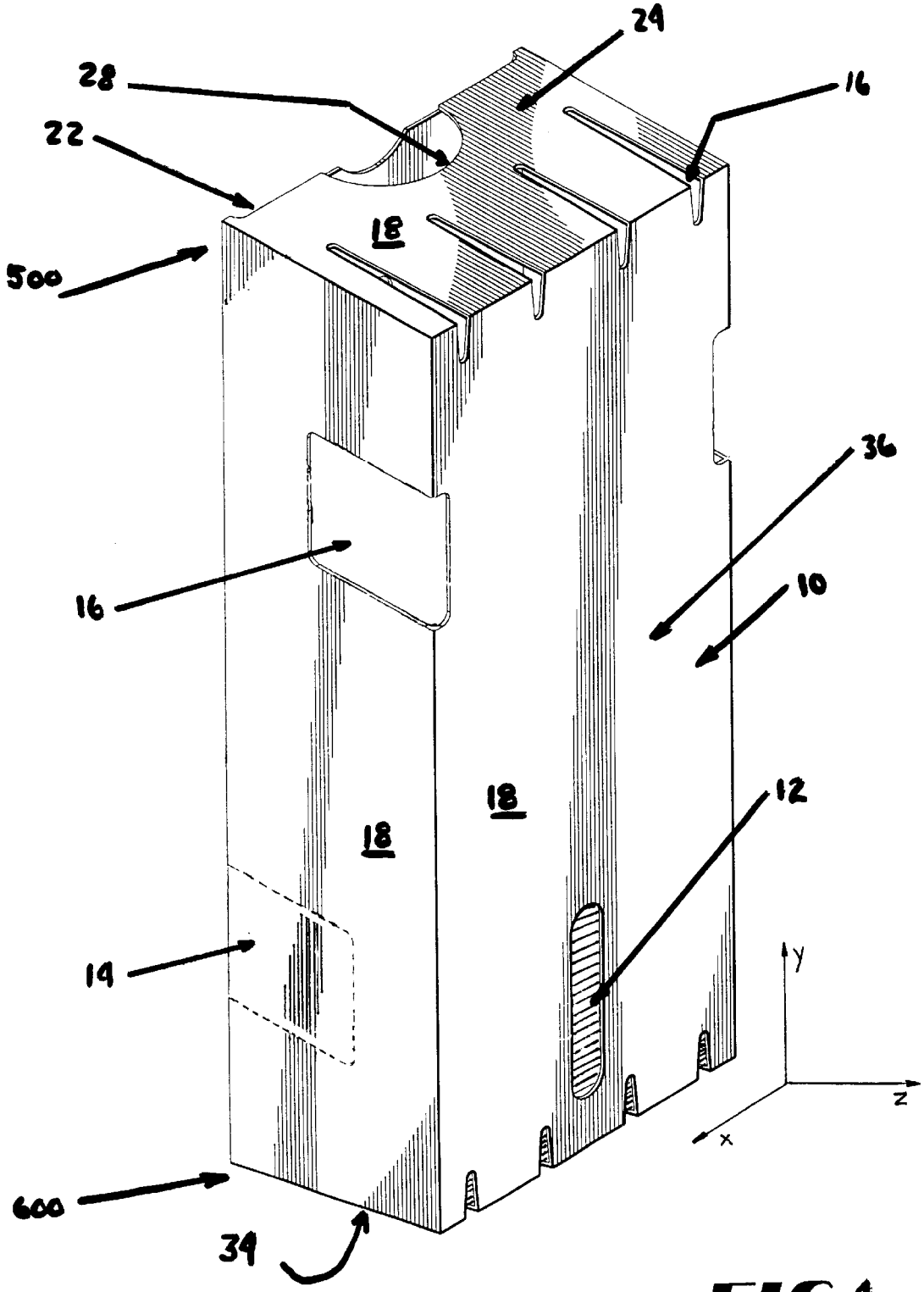
FIG. 1 is a perspective view of an exemplary cartridge for holding a plurality of paper products and dispensing the same therefrom.

Reference will now be made in more detail to the presently preferred embodiments of the invention, one or more examples of which are illustrated in the drawings. Each example is provided by way of explanation of the invention and not meant as a limitation of the invention. For example, features illustrated or described as part of one embodiment or figure can be used on another embodiment or figure to yield yet another embodiment. It is intended that the present invention include such modifications and variations.

As broadly embodied in FIGS. 1–5, one desirable embodiment of a cartridge 10 is disclosed in which paper products 12 are placed and from which paper products 12 are dispensed. The paper products 12 may be paper napkins, paper towels, toilet tissue, or any other similar material. The cartridge 10 comprises a plurality of cartridge walls 18 including a first wall, top wall, or end 24 and a corresponding second wall, bottom wall, or end 34. It should be understood that the terms "top" and "bottom" are used only to describe the relative positions of each wall or end. During use in a dispenser housing, either end of the cartridge 10 may be located at a bottom or dispensing end of he dispenser housing As illustrated in FIGS. 6*a*, 6*b*, and 6*c*, the cartridge 10 s adapted to be inserted into the interior area of a dispenser housing 100, the cartridge 10 is further adapted or holding or containing the paper products 12 to be dispensed. Looking to FIGS. 6*a*, 6*b*, and 6*c* it can be seen that the cartridge 10 is sized to fit snugly within an interior area of the dispenser housing 100.

Looking back to FIGS. 1–5, in general, the cartridge 10 may include a plurality of removable portions 14, the removal of which creates openings 16 through the cartridge 10. The removable portions 14 are disposed in outside walls 18 of the cartridge 10 so that, once the removable portions 14 are removed, the openings 16 encompass and receive protrusions from the dispenser housing 100 that may extend into the cartridge 10. Thus, upon removal of the removable portions 14 and placement of the cartridge 10 into the appropriate dispenser housing 100, portions of the dispenser housing 100 protrude through the openings 16 to contact the paper products 12 within cartridge 10.

Figure 2:
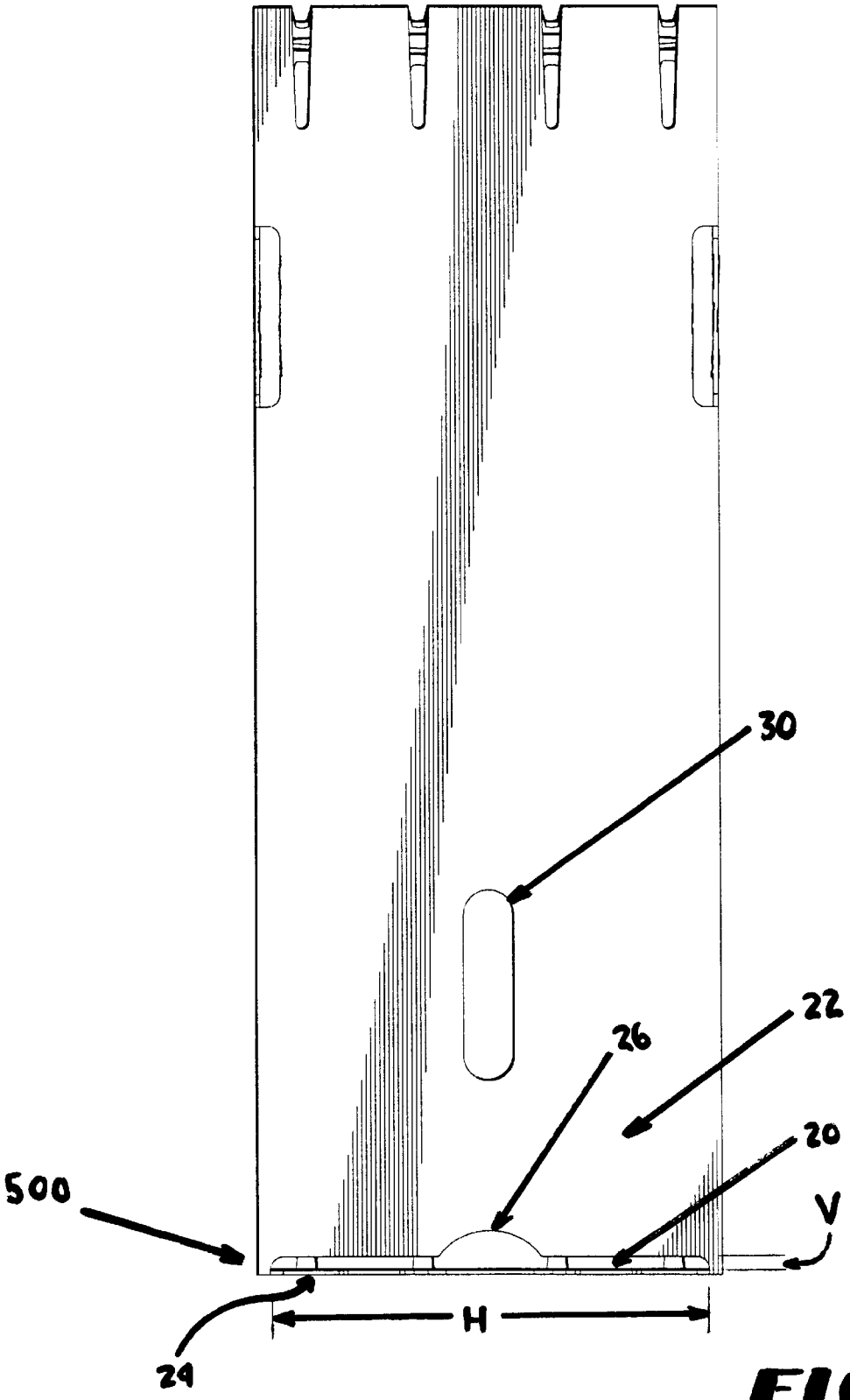
FIG. 2 is a rear elevation view of the FIG. 1 cartridge, which has been rotated 180 degrees end to end about the x-axis.
Figure 4:
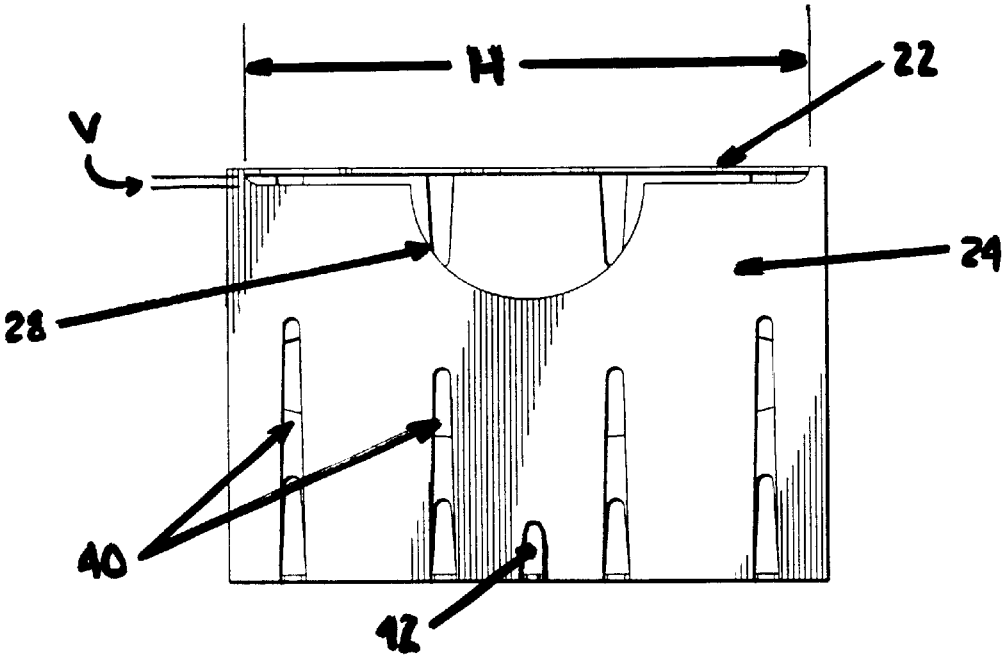
FIG. 4 is a top elevation view of the FIG. 1 cartridge depicting an exemplary slit adapted for the removal of a limited number of paper products in one dispensing event.

FIGS. 2 and 4 depict one desirable dispenser opening in the cartridge 10. A slit, slot, orifice or channel, referred to hereafter as a dispensing throat 20 serves to control access to the paper products 12 contained within the cartridge 10. The dispensing throat 20 is desirably configured to dispense a limited quantity of paper products at each dispense.

Figure 3:
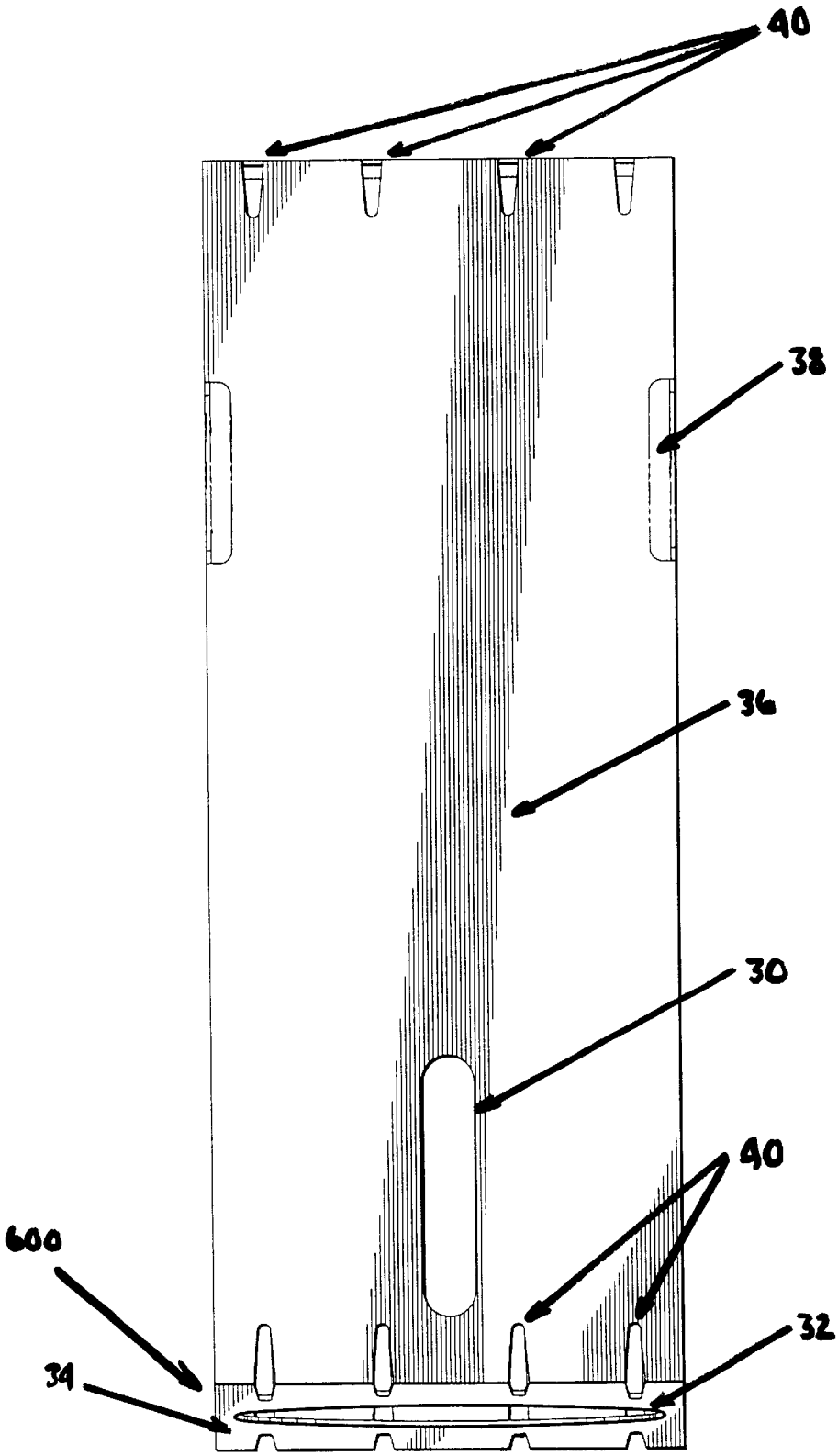
FIG. 3 is a front elevation view of the FIG. 1 cartridge oriented as shown in FIG. 1.
Figure 5:
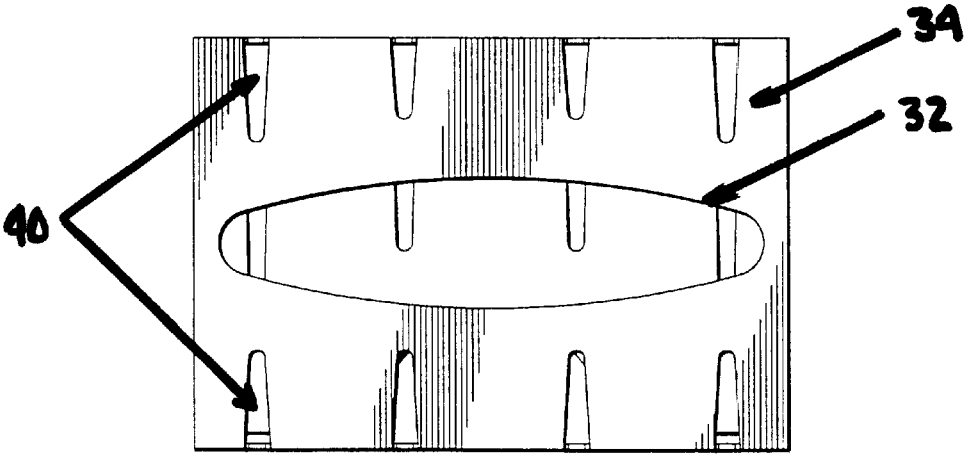
FIG. 5 is a bottom elevation view of the FIG. 1 cartridge depicting an exemplary slit adapted for the removal of a single paper product at a time.
Figure 6A:
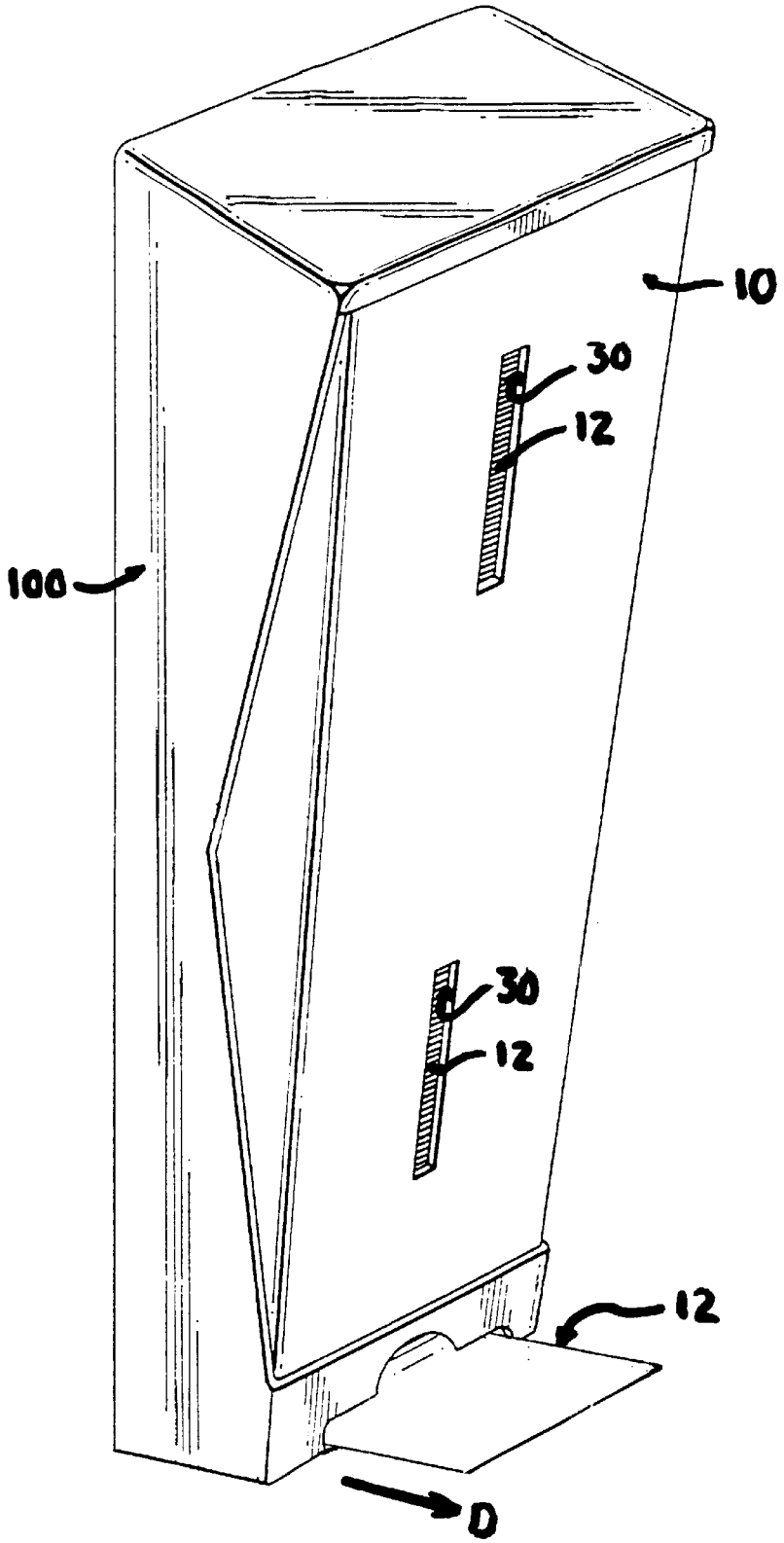
FIG. 6*a* is a perspective view of the FIG. 1 cartridge inserted into one variant of an exemplary dispenser housing, specifically a dispenser housing adapted to dispense a limited number of paper products.
Figure 6B:
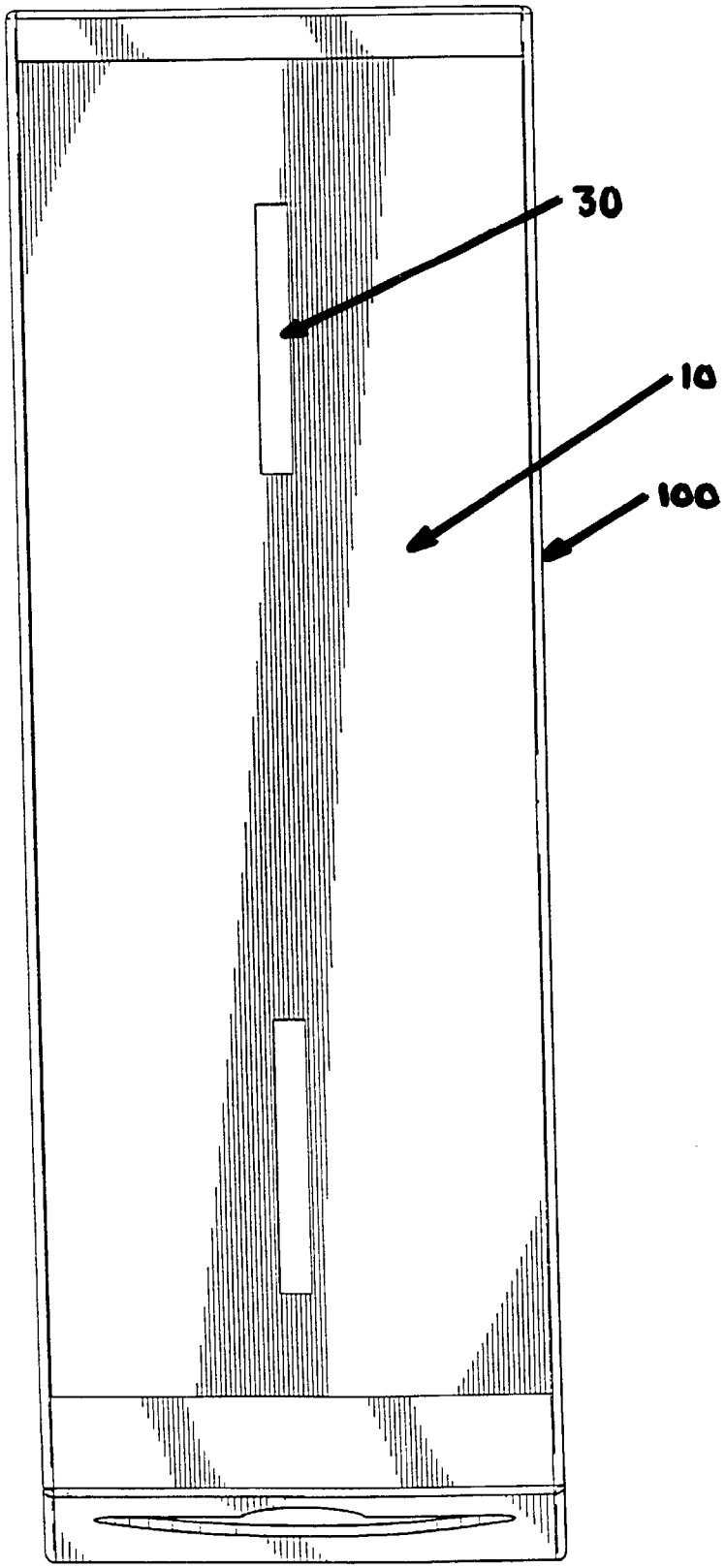
FIG. 6*b* is a front elevation view of the FIG. 1 cartridge inserted into another variant of an exemplary dispenser housing, specifically a dispenser housing adapted to dispense individual paper products or one-at-a-time dispensing.
Figure 6C:
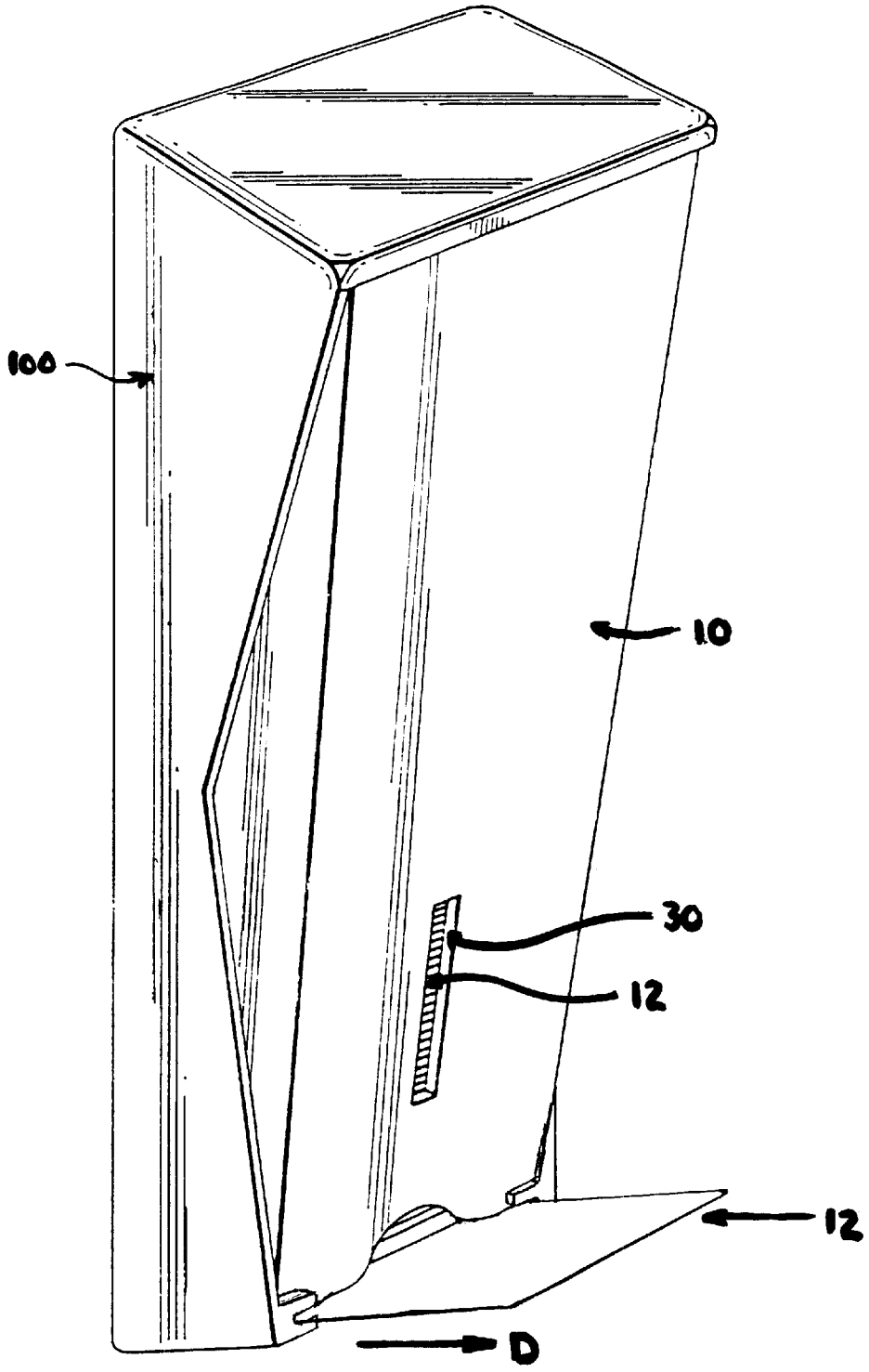
FIG. 6*c* is a front elevation view of the FIG. 1 cartridge inserted into yet another variant of dispenser housing, specifically an alternative variant of an exemplary dispenser housing adapted to dispense individual paper products or one-at-a-time dispensing.

FIGS. 3 and 5 depict another desirable dispenser opening in the cartridge 10. A different slit, slot, orifice or channel, referred to hereafter as a dispensing throat 32 serves to control access to the paper products 12 contained within the cartridge 10. Unlike the dispensing throat 20, the dispensing throat 32 is desirably configured to dispense a ingle paper product at each dispense.

In either case, the cartridge 10 can be provided such hat each dispensing throat 20 and 32 is provided with removable portions 14. This enables a user to select which dispensing throat the paper products 12 are to be dispensed from and to only access that throat.

Before discussing the cartridge 10 in greater detail, it is important to understand that the cartridge 10 includes both a first dispensing throat 20 and a second dispensing throat 32. These throats may be located at opposite ends of the cartridge 10 or at least at different dispensing zones within the cartridge 10 as can be at least partially observed in FIG. 1. This feature enables a single cartridge 10 to be used in different types of dispenser housings, for example, a dispenser housing adapted to dispense a controlled plurality of paper products as well as a dispenser housing adapted to dispense paper products singly, i.e., one-at-a-time.

It is also important to note that FIG. 2 depicts the dispensing throat 20 in dispensing zone 500 at a bottom portion of the cartridge 10. Similarly, FIG. 3 also depicts the dispensing throat 32 in dispensing zone 600 at a bottom portion of the cartridge 10. Since it is more desirable to dispense the paper products 12 from the bottom of the dispenser 100, the cartridge 10 is made to be flipped 180 degrees end for end along the x-axis. Though not required, it is also contemplated that the container could be flipped end for end along the y-axis and/or the z-axis as well. The dispensing throats 20 and 32 could be relocated accordingly to accommodate numerous variations. In either case, the cartridge 10, once flipped is capable of dispensing from either embodiment of the dispenser housing 100. Positioning the cartridge 10 as shown in FIG. 2 such that paper products 12 are dispensed from the dispensing throat 20 allows the cartridge 10 to be used with a dispenser 100 similar to that shown in FIGS. 6*a* or 6*c* whereas the FIG. 3 position using the dispensing throat 32 is adapted to be used with a dispenser 100 similar to that shown in FIG. 6*b*.

To minimize any potential for confusion, all terms referring to the topographical features of the dispenser 10, including the terms "front", "rear" or "back", "top", and "bottom" are used only to refer to their respective positions as depicted in FIG. 1. As such, looking more specifically at FIGS. 2 and 4, it can be seen that the dispensing throat 20 is defined by the cartridge rear wall 22 and top wall 24 of the cartridge. However, it is contemplated that other locations may be used.

The dispensing throat 20 is desirably sized so that it has a horizontal dimension "H" that is about the same as or slightly greater than the width of the paper products 12 within the cartridge 10 and a vertical dimension "V" that is large enough to permit the passage of a limited number of paper products 12. For example, if the paper products 12 are in the form of folded paper napkins, the vertical dimension "V" of the dispensing throat may be sized so that a limited number of folded paper napkins may be extracted. This could be achieved by making the vertical dimension "V" some multiple of the thickness of an individual folded paper napkin (e.g., desirably greater than about 2 and less than about 10 thicknesses, even more desirably greater than about 2 and less than about 6 thicknesses).

Generally speaking, this first dispensing throat 20 provides for the reliable and trouble free dispensing of a corresponding amount of paper products in a single dispensing event. That is, the first dispensing throat 20 may be configured to allow from about 2 to about 10 paper products to dispense in one pull, i.e., dispensing event.

The paper product may be accessed by a thumb slot 26 and/or a finger slot 28. Desirably, these slots are located on the top and rear walls of the cartridge and may be entered with respect to the dimensions of the cartridge 10 or the dimensions of the slot 20. However, whether the thumb slot 26 is located on the rear wall or top wall is a matter of preference. The point to note is that the slot 20 is desirably expanded to include the thumb and/or finger slot(s).

Looking now more particularly to FIGS. 3 and 5, it can be seen that the dispensing throat 32 is defined by the cartridge bottom wall 34 of the cartridge. However, it is contemplated that other locations may be used. The dispensing throat 32 may have many shapes within the scope of the present invention, as long as the throat provides easy access for a user and delivery of paper products 12 for "one-at-a-time" or single product dispensing.

To permit visual inspection of the amount of paper products 12 remaining in the cartridge 10, the cartridge 10 may define at least one additional slot 30 through one of the cartridge walls 18. More desirably, at least one such slot 30 is visible from outside a dispenser housing 100 when the cartridge 10 is in the interior area of the dispenser housing 100. Since the cartridge 10 can be loaded in more than one orientation, it is desirable to provide at least one such slot 30 on the rear wall 22 and at least one such slot 30 on the front wall 36, an amount of paper products 12 disposed within the cartridge 10 being determinable by visually inspecting the amount of paper products 12 through the slot 30. As shown in FIGS. 6*a* an 6*b*, two slots 30 may be provided in the rear wall 22 and in the front wall 36 to provide a greater range of visual inspection. Note that FIGS. 1–3, and 6*c* reflect an embodiment having only one such slot 30 located in the rear wall 22 and in the front wall 36. In fact, any number or arrangement of slots is possible within the scope of the invention.

Figure 7A:
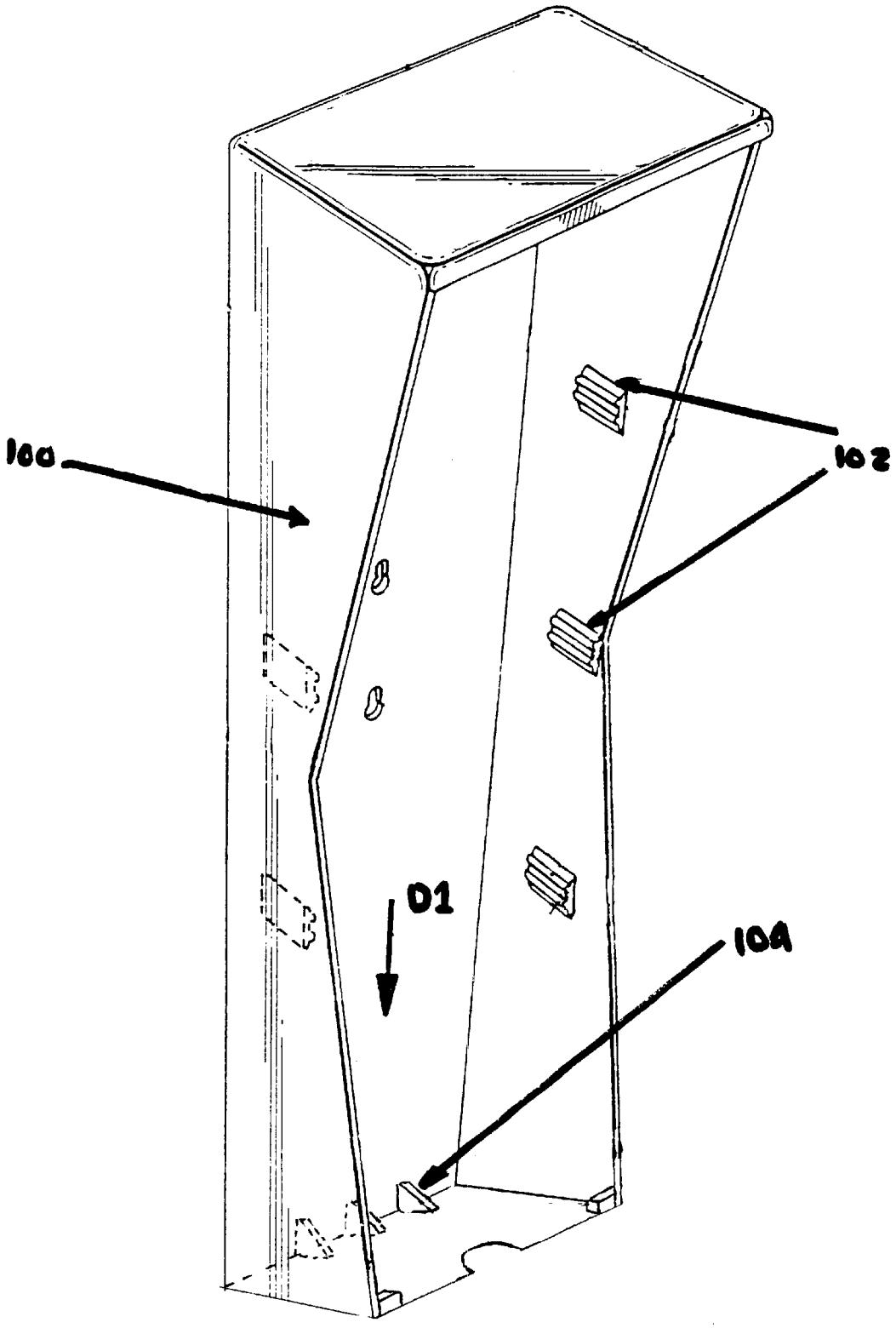
FIG. 7*a* is a perspective view of one exemplary form of dispenser housing for use with the FIG. 1 cartridge.
Figure 7B:
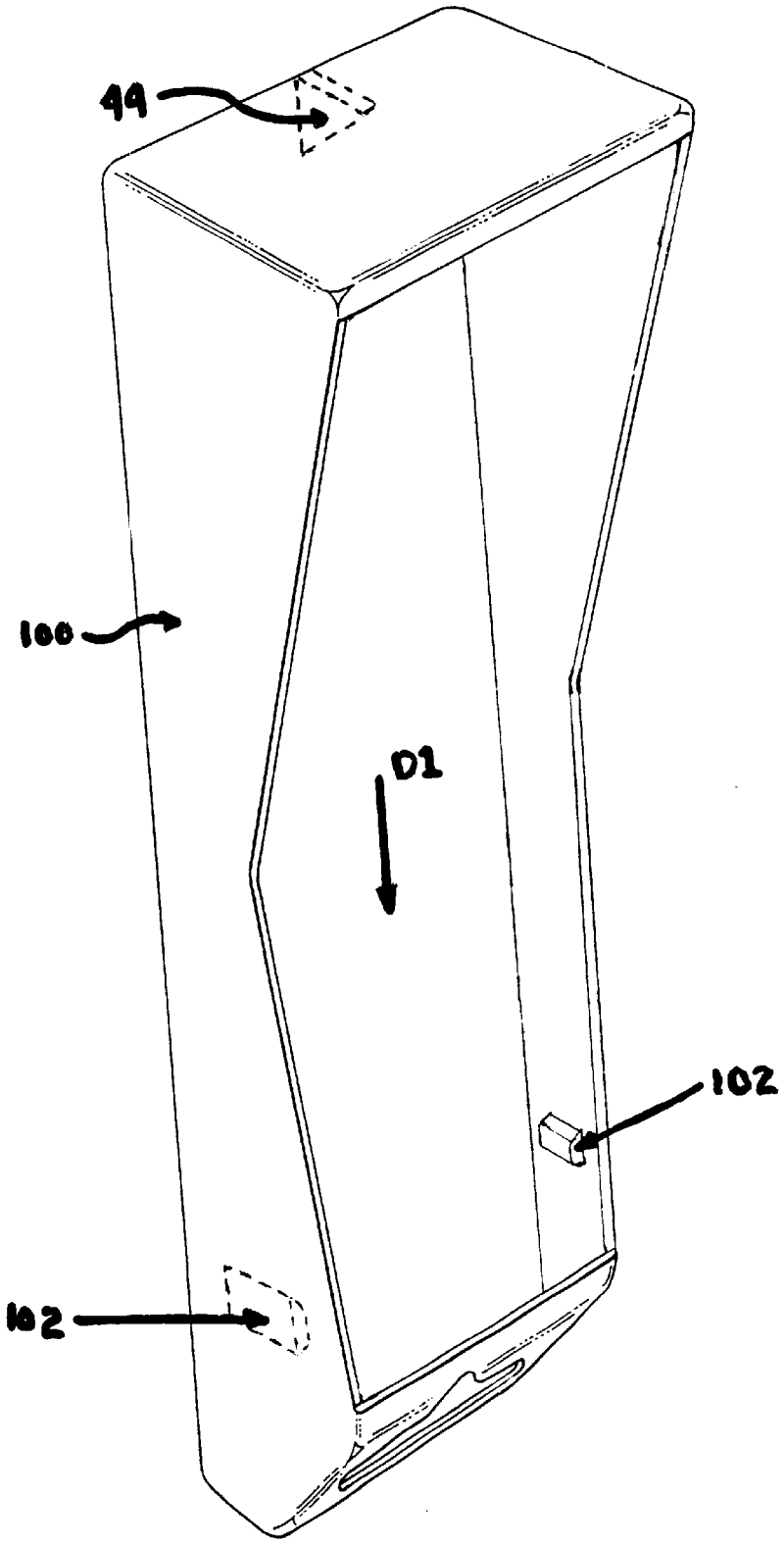
FIG. 7*b* is a perspective view of another exemplary form of dispenser housing for use with the FIG. 1 cartridge.

Further in accordance with the invention, at least some of the openings 16 may have removable portions 14 corresponding to a first group of slots 38 and a second group of slots 40. The first group of slots 38, as shown in FIGS. 7*a* and 7*b*, are adapted to receive at least one protrusion 102, which is generally an attachment to or a part of the dispenser housing 100. These protrusions 102 extend from the dispenser housing 100, through the slot or slots 38 to contact the paper products 12. By contacting the paper products 12, the protrusions 102 impede, without actually prohibiting, the movement of the paper products 12 in a dispensing direction "D1", i.e., toward the dispensing zones 500 or 600 and the dispensing throats 20 or 32 depending upon the dispenser housing used to dispense the paper products 12.

The second group of slots 40 may be provided in the cartridge walls 18 to adapt the cartridge 10 for use in dispenser housings wherein the dispenser housing 100 contains a rib or ribs 104 designed to protrude through the cartridge walls 18, also to contact the paper products 12. These second group of slots 40 are preferably disposed at least partly in the top wall 24 and/or the bottom wall 34 of the cartridge 10 and are adapted to receive the rib members 104 which are mounted or otherwise attached to the dispenser housing 100. These slots 40 enable the rib members 104 to space, slow, align, and support the paper products 12 as they are moved in a dispensing direction "D".

Some of these slots 40 can be of a different size than other of slots 40. In fact, it may be desirable in at least the top wall 24, to make the slots 40 smaller near a centerline of the dispenser 10 and larger near the outer edges of the dispenser 10 as depicted in FIG. 4. This configuration is adapted to accommodate rib members 104 of differing heights. The rib members 104 closest to the centerline are shorter or protrude less distance into the cartridge 10 than do the outermost rib members 104. This has the effect of bowing the center portions of the paper products toward the dispenser throat 20.

Looking further to FIG. 4, it is also contemplated that the cartridge may have at least one additional opening 42. This opening 42 corresponds to a key 44 located on the dispenser housing 10 as shown in FIG. 7*b*. The key 44 would provide the cartridge 10 with a device minimizing the possibility that the cartridge could be improperly loaded into the dispenser housing 100. It is desirable that the key 44 be associated with only one of the dispenser housing variations, i.e., either the configuration designed to dispense a limited quantity of paper products at each dispense or the configuration designed to dispense a single paper product at each dispense. In that way, in the event a custodian were to attempt to incorrectly load the cartridge 10 into a dispenser housing 100, or alternatively attempt to load the cartridge 10 in the wrong orientation, the key 44 would not engage the opening 42 in the cartridge 10 thus preventing the cartridge 10 from seating within the dispenser housing 100.

Generally speaking, removable portions 14 may either be removed or simply not formed in the cartridge walls 18 or ends 24 and/or 34 during manufacture of the cartridge 10. Depending upon the circumstances desired, these removable portions 14 can be removed during installation of the cartridge 10 in the appropriate dispenser housing 10. If the removable portions 14 are to be removed (or simply not formed) as part of the manufacturing process, the cartridge 10 may be shipped to the user wrapped, for example in a polyethylene bag, to prevent contamination and/or to preserve the sterility of the paper products 12 in the cartridge 10. If the removable portions 14 are to be removed as part of the installation process, the edges of the removable portions 14 should be weakened, scored, etc. for easy removal. In one embodiment, it is desirable that the removable portions 14 are either not formed or are removed prior to shipment to the consumer. This minimizes the work necessary in loading the cartridge 10 into a dispenser.

Additional features which could be desirable, are that at least the top wall 24 and/or the bottom wall 34 of the cartridge 10 be disposed at an angle with respect to the front wall 36 and the rear wall 22 of the cartridge 10 as can be seen in FIGS. 3, 6*b*, and 6*c*. However, as depicted in FIGS. 1 and 6*a* it may be more desirable to have the top wall 24, or that wall comprising the dispensing throat 20 to be perpendicular to its adjacent walls. In any case, it is desirable to dispense the paper products 12 from the dispensing throat 20 or 32 so that a face of the paper products 12 is parallel to the top wall 24 or bottom wall 34 from which the paper products 12 are being dispensed.

FIGS. 6*a* and 7*a* depict dispenser housings 100 adapted to work with a perpendicular wall embodiment whereas FIGS. 6*b*, 6*c*, and 7*b* depict dispenser housings 100 adapted to work with an angled wall embodiment. Furthermore, the cartridge 10 is preferably made of heavy paper or cardboard, but may be made of any other suitable material within the scope of the invention.

Figure 8:
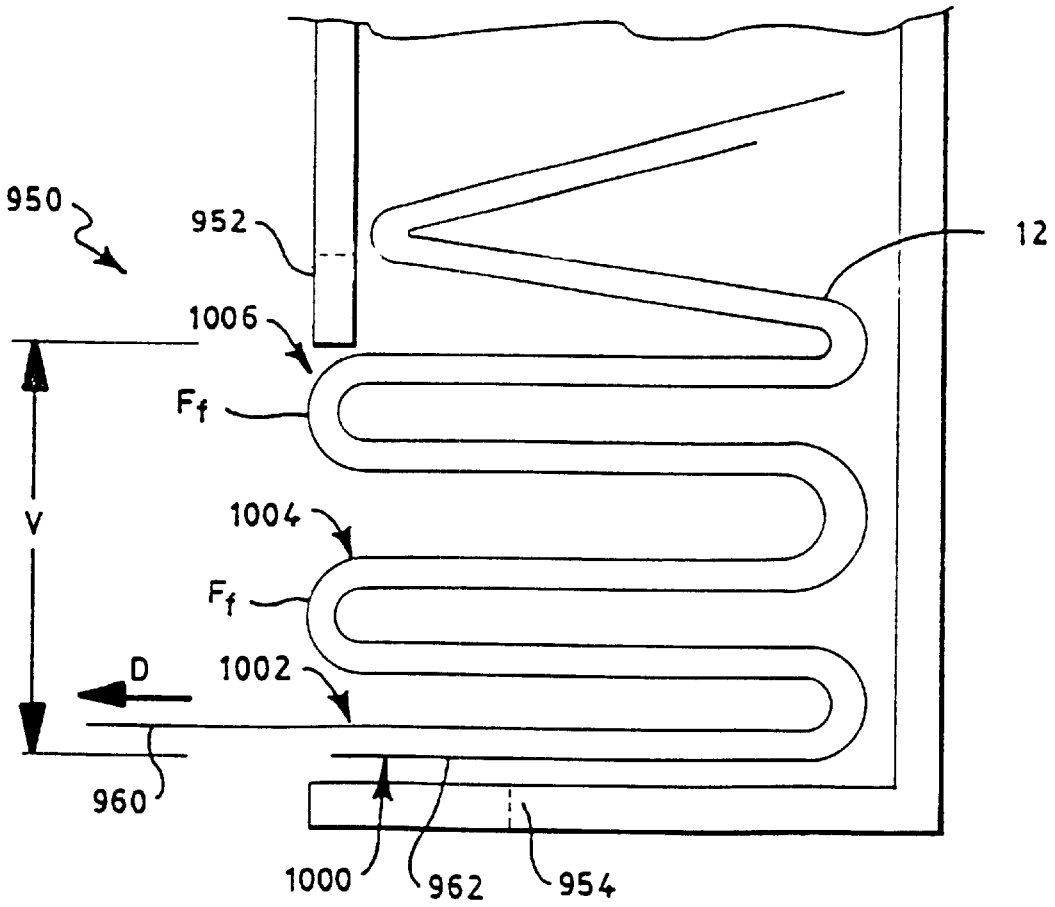
FIG. 8 is an enlarged cross-sectional view (not to scale) of the lower portion of a cartridge and dispenser housing assembly.

FIG. 8 depicts an enlarged cross-sectional view (not to scale) of the lower portion of the cartridge 10 inserted into a dispenser 100 as embodied in FIG. 6*a*. Though not necessary to practice of the invention, the paper products 12 contained within the cartridge 10 are desirably interfolded or tab interfolded napkins to provide metered feeding of one or a number of such individual napkins at any one time. As explained above, and as can be seen in the enlarged and expanded view, the slot 950 has a vertical dimension "V" which is generally some multiple of the thickness of a single layer or ply or fold of the paper product 12. A dispensing direction "D" is identified as generally perpendicular to the housing and cartridge assembly. If the paper product is, for example, an interfolded paper napkin or tissue, a leading flap or tail 960 can be seen extending out of the slot 950 for a user to grasp. Pulling the leading flap 960 will result in one-at-a-time dispensing of the product.

Whereas gripping the interfolded product between lower grip point 1000 and a first upper grip point 1002 engages two of the interfolded paper products (e.g., napkins, tissues, wipes, etc.) for dispensing. One of which has a visible tail 960 extending from the slot 950 (or dispensing throat 20) and the other still located inside the cartridge but accessible through the finger slot 954. Pulling the product engaged at grip points 1000 and 1002 in the dispensing direction "D" will result in two of the interfolded paper products to be dispensed at a time. This result will be consistent provided the interfolding of the product is consistent and the grip areas 1000 and 1002 remain accessible.

Pulling the product engaged at grip points 1000 and 1004 in the dispensing direction "D" will result in four of the interfolded paper products to be dispensed at a time. This result will be consistent provided the interfolding of the product is consistent and the grip areas 1000 and 1004 remains accessible.

FIG. 8 depicts an enlarged cross-sectional view (not to scale) of the lower portion of the cartridge 10 inserted into a dispenser 100 as embodied in FIG. 6*a*. Though not necessary to practice of the invention, the paper products 12 contained within the cartridge 10 are desirably interfolded or tab interfolded napkins to provide metered feeding of one or a number of such individual napkins at any one time. As explained above, and as can be seen in the enlarged and expanded view, the slot 950 has a vertical dimension "V" which is generally some multiple of the thickness of a single layer or ply or fold of the paper product 12. A dispensing direction "D" is identified as generally perpendicular to the housing and cartridge assembly. If the paper product is, for example, an interfolded paper napkin or tissue, a leading flap or tail 960 can be seen extending out of the slot 950 for a user to grasp. Pulling the leading flap 960 will result in one-at-a-time dispensing of the product.

Pulling the product engaged at grip points 1000 and 1006 in the dispensing direction "D" will result in six of the interfolded paper products to be dispensed at a time. This result will be consistent provided the interfolding of the product is consistent and the grip areas 1000 and 1006 remains accessible. This can be described mathematically for interfolded products as $N=F_f \times 2$ where N=the number of products dispensed, $F_f$=the number of forward folds ($F_f$) falling between the identified grip points and which are gripped by the user. The number of forward folds ($F_f$) available for gripping is generally limited only by the vertical dimension of the slot "V" and the size of the finger and/or thumb slots. Generally speaking, the "stack" of product dispensed will be in a folded configuration except for the leading and trailing edge or flap. Of course, if the product is dispensed one-at-a-time, it will be in an unfolded configuration.

If a non-interfolded product is used in the cartridge, the dispensing direction "D" remains the same. However, there will be no leading flap as in the interfolded format. Generally speaking, the number of products dispensed will be the same as the number of forward folds gripped unless the product is double or triple folded.

Thus, it can be seen how the cartridge 10 may be used in dispenser housings 100 designed to dispense a controlled amount of paper products 12. The cartridge 10 may also be used in dispenser housings 100 designed to dispense paper products singly, i.e., one at a time. This could be accomplished by providing access only to a portion of the face of the paper product 12. For example, if the paper products are in the form of folded paper napkins, and only an exposed face of a single napkin is accessible to a user, extracting that napkin from the cartridge 10 leaves the next napkin in the stack exposed.

RELATED APPLICATIONS

This application is one of a group of commonly assigned patent applications which have been previously filed. This group includes application Ser. No. 09/991,669 filed on Dec. 15, 1997 by Paul Tramontina, application Ser. No. 09/156,230 filed on Sep. 18, 1998 by Paul Tramontina, and application Ser. No. 09/206,956 filed on Dec. 8, 1998 by Paul Tramontina et al. The subject matter of these applications is hereby incorporated herein by reference.

It will be apparent to those skilled in the art that various modifications and variations can be made in the present invention without departing from the scope and spirit of the invention. It is intended that the present invention include such modifications and variations as come within the scope of the appended claims and their equivalents.

What is claimed is:

1. A cartridge for holding and dispensing a plurality of paper products, the cartridge being insertable into an interior area of a dispenser housing, the cartridge comprising:

a cartridge body including a plurality of cartridge walls that define a first dispensing zone and a second dispensing zone;

a first dispensing throat defined by at least one cartridge wall at the first dispensing zone; and a second dispensing throat defined by at least one cartridge wall at the second dispensing zone;

wherein access to and dispensing of paper products therein is controlled by inserting the cartridge into a dispenser housing such that a specific dispensing throat, selected from the first and the second dispensing throat, is in a dispensing position.

2. The cartridge of claim 1 wherein the cartridge is configured so that the first dispensing throat is defined by a rear and a top wall of the cartridge and the second dispensing throat is defined by a bottom wall of the cartridge.

3. The cartridge of claim 1 wherein the cartridge is configured so that the first dispensing throat is at least partially defined by a first wall of the cartridge and the second dispensing throat is wholly defined by a second wall of the cartridge.

4. The cartridge of claim 3 wherein the first wall lies in a plane parallel to a plane defined by a face of the paper product nearest the first wall and the second wall lies in a plane parallel to a plane defined by a face of the paper product nearest the second wall.

5. The cartridge of claim 1, wherein the cartridge is configured so the first dispensing throat is sized to have a horizontal dimension about the same as or slightly greater than the width of the paper products within the cartridge and a vertical dimension that is large enough to permit the passage of a limited number of paper products.

6. The cartridge of claim 5, wherein the cartridge is configured so the vertical dimension of the dispensing throat is between about 2 and about 10 times the thickness of an individual folded paper product.

7. The cartridge of claim 1, wherein the cartridge is configured so that at least one dispensing throat further comprises a thumb slot and a finger slot.

8. A cartridge for holding and dispensing a plurality of paper products, the cartridge comprising:

a cartridge body including a plurality of cartridge walls; and a plurality of openings defined in the cartridge body, at least some of the openings being located in the cartridge body and adapted to engage a first dispenser housing configured for the dispensing of paper products from one of the openings, and at least some other of the openings being located in the cartridge body and adapted to engage a second dispenser housing configured for the dispensing of paper products from a different one of the openings.

9. A cartridge for holding and dispensing a plurality of paper products, the cartridge comprising:

a cartridge body including a plurality of cartridge walls; and a plurality of openings defined in the cartridge body, at least some of the openings being located in the cartridge body and adapted to engage a first dispenser housing, and at least some other of the openings being located in the cartridge body and adapted to engage a second dispenser housing, wherein at least one of the openings is adapted to dispense a metered plurality of paper products in a single dispense.

10. The cartridge of claim 9, wherein the opening is adapted to dispense between about 2 and about 10 individual paper products in a single dispense.

11. The cartridge of claim 8 wherein at least one of the openings is adapted to dispense a single paper product at each dispense.

12. A cartridge for holding and dispensing a plurality of paper products, the cartridge comprising:

a cartridge body including a plurality of cartridge walls; and a plurality of openings defined in the cartridge body, at least some of the openings being located in the cartridge body and adapted to engage a first dispenser housing, and at least some other of the openings being located in the cartridge body and adapted to engage a second dispenser housing, wherein a first opening adapted to dispense a metered plurality of paper products in a single dispense, and a second, alternative opening is adapted to dispense a single paper product at each dispense.

13. The cartridge of claim 12 wherein the cartridge is configured so that the first opening is at least partially defined by a first wall of the cartridge and the second opening is wholly defined by a second wall of the cartridge.

14. The cartridge of claim 12 wherein the cartridge is configured so that the first opening is defined by a first wall and a second, adjacent wall of the cartridge and the second opening is defined by a third wall of the cartridge.

15. The cartridge of claim 12 wherein the first opening is defined by a top wall, and a rear wall of the cartridge, and the second opening is defined by a bottom wall of the cartridge.

16. The cartridge of claim 12 wherein the plurality of paper products is in face-to-face stacked relation, wherein the first opening is at least partially defined by a wall of the cartridge disposed parallel to a face of the nearest paper product from the plurality of paper products, and the second opening is wholly defined by a wall of the cartridge disposed parallel to a face of the nearest paper product from the plurality of paper products.

17. The cartridge of claim 16 wherein the first opening and second opening are located at opposite ends of the stack of paper products.

18. A cartridge for holding and dispensing a plurality of paper products in a dispensing direction, the cartridge being insertable into an interior of a first variation of dispenser housing adapted to dispense a metered plurality of paper products, the cartridge further being insertable into an interior of a second variation of dispenser housing adapted to dispense a single paper product at each dispense, the cartridge comprising:

a cartridge body comprising a plurality of cartridge walls defining a first and a second dispensing throat, each dispensing throat configured to guide paper products in a dispensing direction through one of the dispensing throats;

wherein the first dispensing throat is located in an end wall of the cartridge; and wherein the second dispensing throat is at least partially located in an end wall of the cartridge;

wherein access to and dispensing of paper products therein is controlled by inserting the cartridge into a dispenser housing such that a specific dispensing throat, selected from the first and the second dispensing throat, is in a dispensing position.

19. The cartridge of claim 18 further comprising additional openings within the cartridge walls adapted to receive structural components from the dispenser housing for interaction with the plurality of paper products contained within the cartridge, such interaction for assisting in the proper dispensing of paper products from the dispenser.

20. The cartridge of claim 19 further comprising removable portions sealing the openings, the removable portions adapted to be selectively removed from the cartridge walls.

21. The cartridge of claim 18 wherein the paper products are interfolded napkins.

22. The cartridge of claim 18 wherein the first dispensing throat is located in a first end wall of the cartridge and the second dispensing throat is at least partially located in a second end wall of the cartridge.

23. The cartridge of claim 18 further comprising at lest one additional opening within the cartridge walls adapted to engage at least one variation of dispenser housing;

wherein correct orientation of the additional opening enables the cartridge to be inserted into the dispenser housing so that one of the dispensing throats is in a dispensing position; and wherein incorrect orientation of the additional opening prevents the cartridge from being inserted into the dispenser housing.

* * * * *